US005532547A

United States Patent [19]

Park et al.

[11] Patent Number: 5,532,547

[45] Date of Patent: Jul. 2, 1996

[54] ELECTRON GUN FOR A COLOR CATHODE-RAY TUBE

[75] Inventors: Sang W. Park, Gumi; Hyun C. Kim, Kyungsangbuk-do, both of Rep. of Korea

[73] Assignee: Goldstar Co., Ltd., Seoul, Rep. of Korea

[21] Appl. No.: 312,506

[22] Filed: Sep. 26, 1994

Related U.S. Application Data

[63] Continuation-in-part of Ser. No. 998,782, Dec. 28, 1992, abandoned.

[30] Foreign Application Priority Data

Dec. 30, 1991 [KR] Rep. of Korea ..... 91-24988
Dec. 30, 1991 [KR] Rep. of Korea ..... 91-25242

[51] Int. Cl.[6] ..... H01J 29/58

[52] U.S. Cl. ..... 313/414; 313/412; 313/432; 313/460; 315/382; 315/368.15

[58] Field of Search ..... 313/414, 412, 313/428, 432, 437, 439, 444, 460; 315/15, 382, 382.1, 368.15

[56] References Cited

U.S. PATENT DOCUMENTS

| | | | |
|---|---|---|---|
| 4,731,563 | 3/1988 | Bloom et al. | 313/414 X |
| 4,771,216 | 9/1988 | Blacker et al. | 315/382 |
| 4,772,826 | 9/1988 | Bloom et al. | 313/414 X |
| 4,772,827 | 9/1988 | Osakabe | 313/414 X |
| 4,886,999 | 12/1989 | Yamane et al. | 313/414 |
| 4,887,009 | 12/1989 | Bloom et al. | 313/414 X |
| 5,036,258 | 7/1991 | Chen et al. | 313/414 X |
| 5,055,749 | 10/1991 | Chen et al. | 315/382 |
| 5,061,881 | 10/1991 | Suzuki et al. | 313/414 X |
| 5,142,190 | 8/1992 | Koh | 313/412 X |
| 5,281,896 | 1/1994 | Bae et al. | 313/414 |
| 5,300,855 | 4/1994 | Kweon | 313/412 X |
| 5,350,967 | 9/1994 | Chen | 313/412 X |

*Primary Examiner*—Sandra L. O'Shea
*Assistant Examiner*—Ashok Patel
*Attorney, Agent, or Firm*—Poms, Smith, Lande & Rose

[57] ABSTRACT

An electron gun for a color cathode-ray tube, adapted for large television sets or high-definition monitors, has first and second quadrupole electrodes connected to a static voltage focus electrode and to a dynamic voltage focus electrode, respectively, to form a quadrupole lens. The first quadrupole electrode is composed of first electrode pieces connected to the static voltage focus electrode and arranged on left and right sides of three beam-passing apertures formed on the static voltage focus electrode, and each of the first electrode pieces has at least one arc having a radius identical to or larger than that of the beam-passing apertures. The second quadrupole electrode is composed of second electrode pieces connected to upper and lower portions of the dynamic voltage focus electrode, and each of the second electrode pieces has arcs having a radius identical or larger than that of the beam-passing apertures. The first electrode pieces are inserted inside of the second electrode pieces.

4 Claims, 9 Drawing Sheets

ELECTRON GUN FOR A COLOR CATHODE-RAY TUBE

CROSS-REFERENCE TO RELATED APPLICATION

This is a continuation-in-part of application Ser. No. 07/998,782 filed on Dec. 28, 1992, now abandoned.

BACKGROUND OF THE INVENTION

1. Field of the Invention

The present invention relates to an electron gun for a color cathode-ray tube for use in a large television set or a high-definition monitor, and more particularly to an improvement in the deterioration of resolution on the peripheral regions of the screen.

2. Description of the Prior Art

A conventional color display system, as shown in FIG. 1, is composed of a cathode-ray tube and a deflection yoke. The tube is composed of a panel and a funnel in which an electron gun is installed in a neck of the funnel.

Generally, the electron gun consists of a beam-forming region and a main lens. The beam-forming region is composed of cathodes 2*a*,2*b* and 2*c*, a G1 (control) electrode and a G2 (accelerator) electrode 4. Thermions activated by the cathodes are controlled and accelerated by the G1 and the G2 electrodes, respectively, to form electron beams. A voltage of about 0 V is applied to the G1 electrode, and a voltage of about 500 V to 700 V is applied to the G2 electrode.

The main lens is composed of a G3 (focus) electrode 5 and a G4 (anode) electrode 6. The high voltage of about 25 KV to 30 KV is applied to the G4 (anode) electrode, and an intermediate voltage of about 20% to 30% of the G4 (anode) voltage is applied to the G3 electrode. According to the difference between the G3 electrode voltage and the G4 electrode voltage, an electrostatic lens is formed. This electrostatic lens functions to focus the electron beams formed by the beam-forming region on the screen of the tube.

Generally, the focused electron beams consists of three electron beams of red(R), green(G), and blue(B) colors. In a color cathode-ray tube using an in-line type electron gun, a self-convergence magnetic field, which is a nonuniform deflection magnetic field of the deflection yoke, is produced in order to focus the three electron beams of R, G, and B colors onto one spot. FIGS. 3A and 3B show the distribution of the self-convergence magnetic field formed as above. This magnetic field may be separated into a dipole component and a quadrupole component as shown in FIGS. 3C and 3D. The dipole component effects a main deflection of the electron beams in a horizontal direction, while the quadrupole component forces the electron beams to be converged in a vertical direction and to be diverged in a horizontal direction, causing astigmatism to be developed.

As shown in FIG. 5, spots of the electron beams are different in the horizontal and vertical directions and over-focused on the screen, resulting in that deterioration in resolution increases with the distance from the center of the screen to the peripheral portion of the screen. Such a nonuniform magnetic field consists of a pin cushion magnetic field and a barrel magnetic field as shown in FIGS. 3A and 3B. Accordingly, as shown in FIG. 4, the shape of the electron beam in the peripheral portion of the screen goes with haze in a vertical direction, thereby deteriorating resolution in the peripheral portion of the screen.

In order to solve the above-mentioned problems, there have been various types of electron guns utilizing a dynamic quadrupole electrode for compensating for the astigmatism when the electron beam is deflected to the peripheral portion of the screen, as shown in Blacker et al. U.S. Pat. No. 4,771,216, Osakaba U.S. Pat. No. 4,772,827, Bloom et al. U.S. Pat. No. 4,887,009, Chen et al. U.S. Pat. Nos. 5,036,258 and 5,055,749, Suzuki et al. U.S. Pat. No. 5,061,881, and Bae et al. U.S. Pat. No. 5,281,896. According to the above patents, a quadrupole lens or a multipole lens is formed by installing a quadrupole electrode or a multipole electrode between the beam-forming region and the main lens to compensate for astigmatism. In forming the quadrupole lens, a G3 (focus) electrode is separated into a first focus electrode and a second focus electrode, and the quadrupole electrode for forming the quadrupole lens is provided between the first and second focus electrodes. A static focus voltage is applied to the first focus electrode and a dynamic focus voltage, which varies according to the deflection amount of the electron beam, is applied to the second focus electrode. Generally, the dynamic focus voltage is determined to be higher than the static focus voltage. As shown in FIG. 20, the dynamic focus voltage is applied with a horizontal parabolic waveform and a vertical parabolic waveform in accordance with the scanning direction of the electron beam.

U.S. Pat. No. 4,771,216 discloses an electron gun in which rectangular beam-passing apertures are formed on a first focus electrode (i.e., a static electrode), and partitions are formed on a second focus electrode so as to be located on the upper and lower portions of the beam-passing apertures as shown in FIG. 8. The rectangular beam-passing apertures and the partitions located on the upper and lower portions of the beam-passing apertures constitute a quadrupole lens to compensate for astigmatism.

U.S. Pat. No. 4,772,827 discloses an electron gun in which a quadrupole lens is formed between first and second focus electrodes as shown in FIG. 10. The first focus electrode has vertical partitions formed thereon in a horizontal direction of the electron beams, and the second focus electrode has horizontal partitions formed thereon in a vertical direction of the electron beams. The horizontal and vertical partitions constitute a quadrupole lens for compensating for astigmatism.

U.S. Pat. No. 4,887,009 discloses an electron gun in which first and second focusing electrodes have burrings extended therefrom, respectively, as shown in FIG. 7. The burrings of the first and second focusing electrodes are engaged with each other and constitute a quadrupole lens for compensating for astigmatism.

U.S. Pat. Nos. 5,036,258 and 5,055,749 discloses an electron gun in which a key-hole-shaped quadrupole electrode is formed between first and second focus electrodes to compensate for astigmatism as shown in FIG. 9.

U.S. Pat. No. 5,061,881 discloses an electron gun in which beam-passing holes formed on a first focus electrode are in the shape of a vertically-elongated rectangle and those formed on a second focus electrode are in the shape of a horizontally-elongated rectangle to form a quadrupole lens for compensating for astigmatism.

SUMMARY OF THE INVENTION

It is an object of the present invention to provide an electron gun wherein an improved quadrupole electrode structure is employed to provide an improvement in resolution in the peripheral portion of the screen in a color cathode-ray tube.

In order to achieve the above object, there is provided an electron gun for a color cathode-ray tube comprising:

a plurality of electron emission means for emitting electron beams;

a beam-forming region composed of a control electrode for controlling a quantity of said electron beams emitted from said plurality of electron emission means, and an accelerator electrode for accelerating said controlled electron beams;

a plurality of focus electrodes for forming a main static focus lens for focusing said electron beams on a screen of said cathode-ray tube, one of said plurality of focus electrodes forming a static voltage focus electrode by applying thereto a static voltage, and one of the remaining focus electrodes forming a dynamic voltage focus electrode by applying thereto a dynamic voltage;

an anode for accelerating said focused electron beams onto said screen; and quadrupole electrode means, provided between said static voltage focus electrode and said dynamic voltage focus electrode, for forming a quadrupole lens, said quadrupole electrode means comprising a first quadrupole electrode which is composed of a plurality of first electrode pieces connected to one surface of said static voltage focus electrode and arranged on left and right sides of beam-passing apertures formed on said static voltage focus electrode, each of said first electrode pieces having at least one arc having a radius identical to or larger than that of said beam-passing apertures, and a second quadrupole electrode which is composed of a plurality of second electrode pieces connected to upper and lower portions of one surface of said dynamic voltage focus electrode opposite to said static voltage focus electrode, each of said second electrode pieces having arcs having a radius identical to or larger than that of beam-passing apertures formed on said dynamic voltage focus electrode;

wherein said static voltage focus electrode and said dynamic voltage focus electrode are arranged at predetermined intervals; and said first quadrupole electrode pieces connected to said static voltage focus electrode are inserted inside of said second quadrupole electrode pieces connected to said dynamic voltage focus electrode.

Alternatively, said quadrupole electrode means, provided between said static voltage focus electrode and said dynamic voltage focus electrode, may comprise a first quadrupole electrode composed of a plurality of vertical partitions connected to one surface of said static voltage focus electrode and arranged on left and right sides of beam-passing apertures formed on said static voltage focus electrode, and a second quadrupole electrode composed of a flat plate connected to said dynamic voltage focus electrode and having a horizontally-elongated opening therein in alignment with said beam-passing apertures, upper and lower portions of said opening having arcs having a radius identical to or larger than that of said beam-passing apertures;

Wherein said static voltage focus electrode and said dynamic voltage focus electrode are arranged at predetermined intervals, and said vertical partitions connected to said static voltage focus electrode are inserted inside of said horizontally-elongated opening formed on said second quadrupole electrode.

BRIEF DESCRIPTION OF THE DRAWINGS

The above object and other features of the present invention will become more apparent by describing the preferred embodiments thereof with reference to the accompanying drawings, in which.

DETAILED DESCRIPTION OF THE PREFERRED EMBODIMENTS

Figure 1:
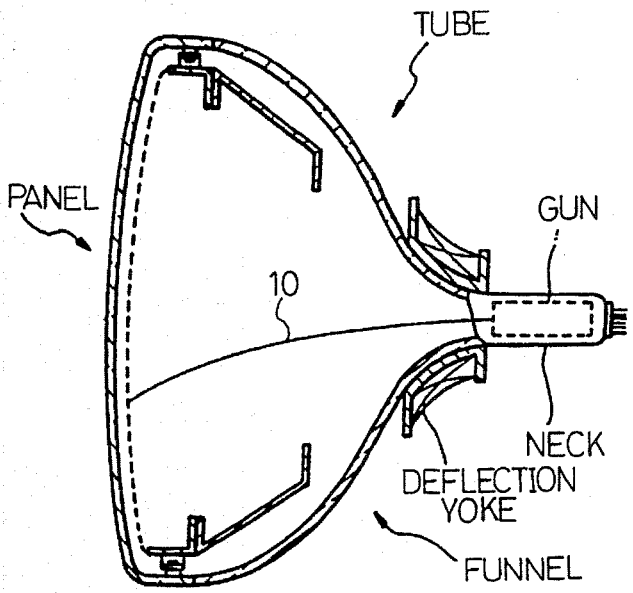
FIG. 1 (PRIOR ART)
FIG. 1 is a cross-sectional view of a typical color cathode-ray tube.
Figure 2:
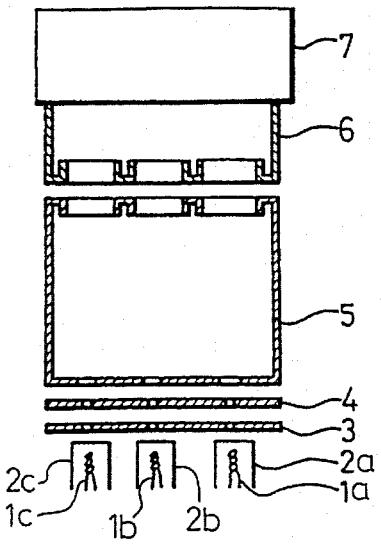
FIG. 2 (PRIOR ART)
FIG. 2 is a cross-sectional view showing the structure of a conventional electron gun.
Figure 3A:
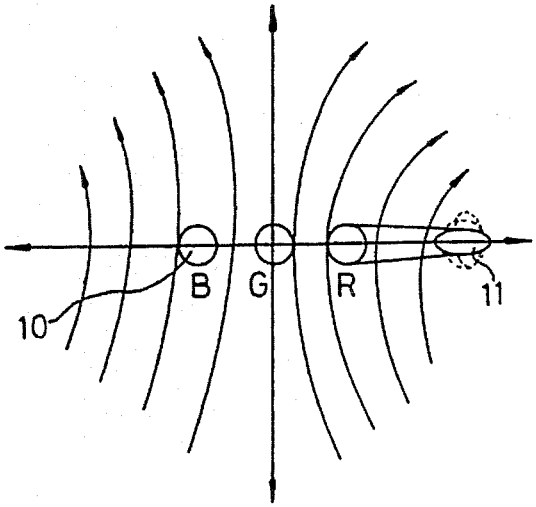
FIG. 3A (PRIOR ART)
FIGS. 3A to 3D are views showing the characteristics of electron beam spots and self-convergence magnetic fields formed by a conventional electron gun.
Figure 3B:
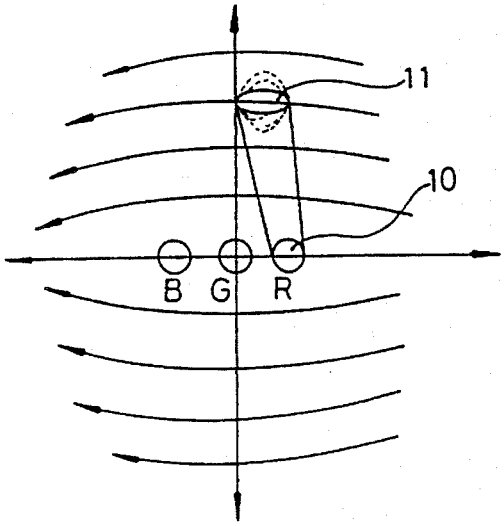
FIG. 3B (PRIOR ART)
Figure 3C:
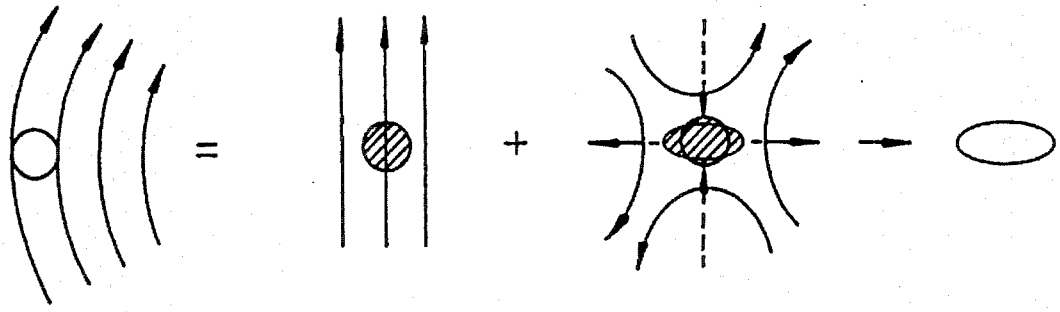
FIG. 3C (PRIOR ART)
Figure 3D:
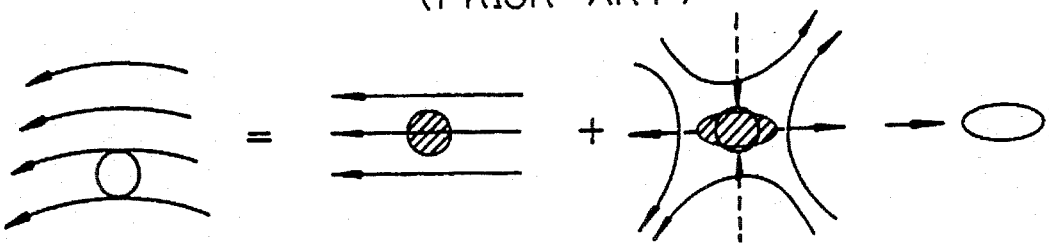
FIG. 3D (PRIOR ART)
Figure 4:
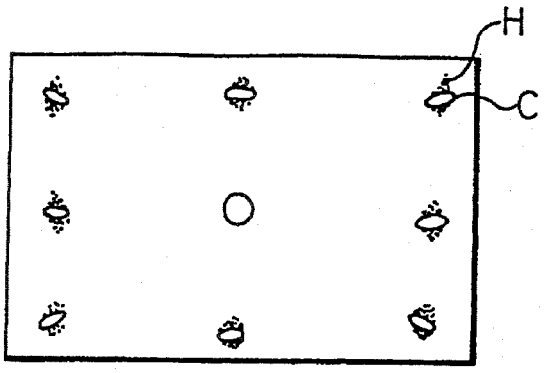
FIG. 4 (PRIOR ART)
FIG. 4 is a view explaining electron beam spots formed on a display screen by a conventional electron gun.
Figure 5:
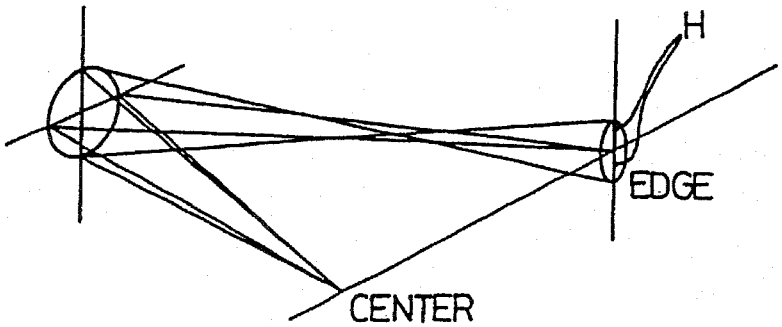
FIG. 5 (PRIOR ART)
FIG. 5 is a reference diagram explaining FIG. 4.
Figure 6:
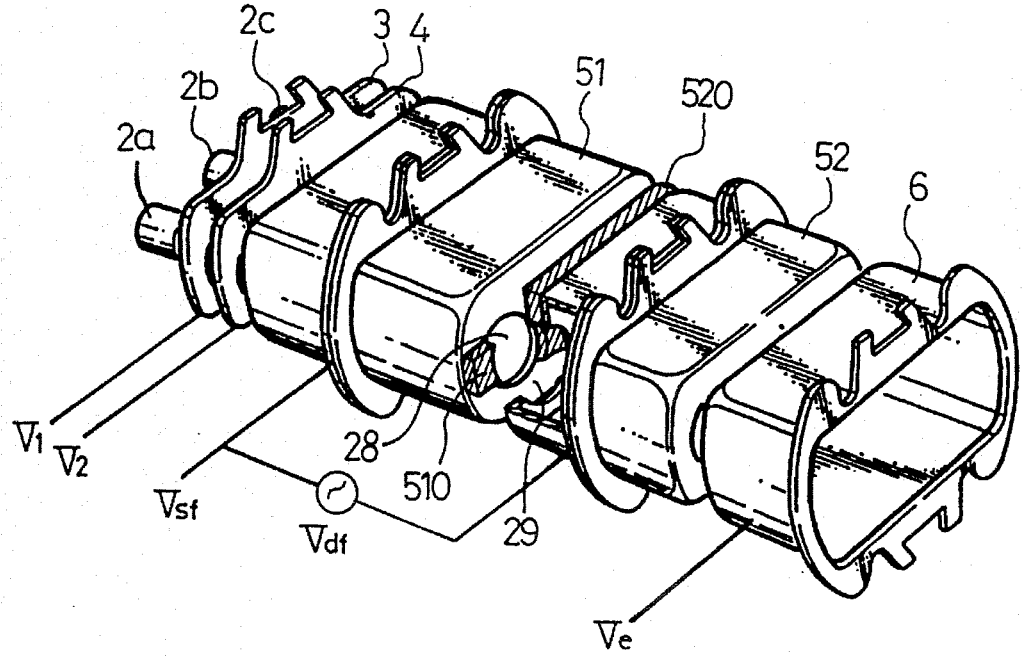
FIG. 6 is a partially cutaway perspective view of the electron gun according to one embodiment of the present invention.
Figure 7:
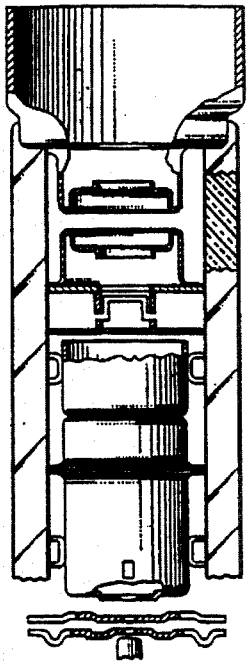
FIG. 7 (PRIOR ART)
FIG. 7 is a partially cutaway sectional side view of another conventional electron gun.
Figure 8:
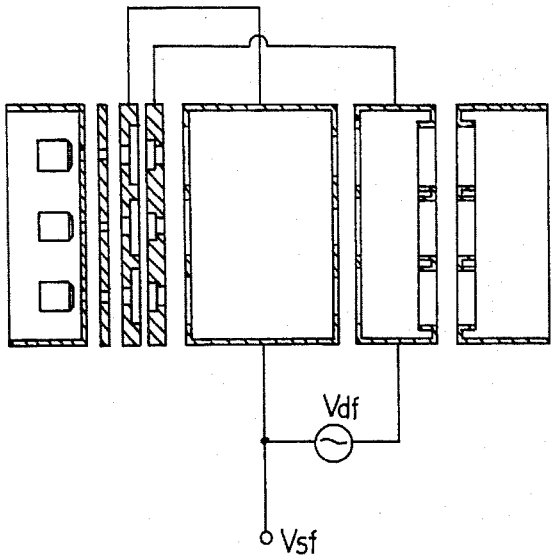
FIG. 8 (PRIOR ART)
FIG. 8 is a horizontal sectional view of still another conventional electron gun utilizing a quadrupole lens electrode.
Figure 9:
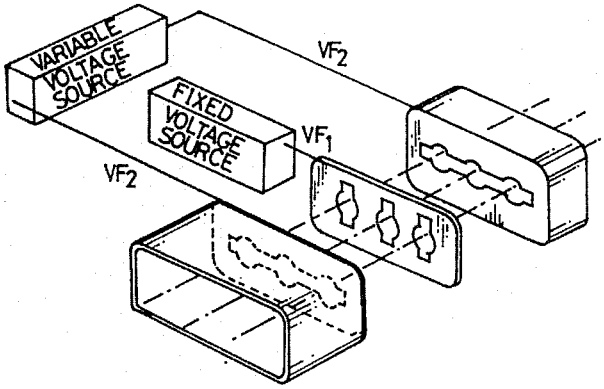
FIG. 9 (PRIOR ART)
FIG. 9 is an exploded perspective view of another quadrupole lens electrode of still another conventional electron gun.
Figure 10:
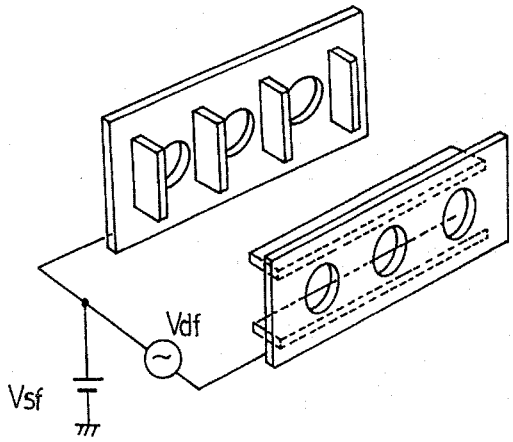
FIG. 10 (PRIOR ART)
FIG. 10 is an exploded perspective view of still another quadrupole lens electrode of still another conventional electron gun.

FIG. 6 shows the structure of the electron gun according to one embodiment of the present invention. Referring to FIG. 6, the electron gun according to the present invention is provided with a beam-forming region for forming electron beams, a main lens for focusing the electron beams, and quadrupole electrodes (or multiple electrodes) 510 and 520 provided between the beam-forming region and the main lens to compensate for astigmatism in accordance with a deflection amount of the electron beams.

As described above, the electron beams are focused depending on the difference between a G3 (focus) electrode voltage and a G4 electrode (anode) voltage. In order to compensate for astigmatism in accordance with the deflection amount of the electron beams, a method of varying the voltage difference of the main lens has been widely used in the art as the most favorable compensation method. In order to vary the voltage difference of the main lens, the G3 (focus) electrode voltage must be varied, and accordingly, the G3 electrode is separated into two electrodes, a first focus electrode 51 and a second focus electrode 52. The first focus electrode 51 is arranged adjacent to a G2 (accelerating) electrode 4, and the second focus electrode 52 is arranged adjacent to a G4 electrode (anode) 6. A static focus voltage is applied to the first focus electrode 51 and a dynamic focus voltage which varies according to the deflection amount of the electron beam is applied to the second focus electrode 52.

The quadrupole electrodes (or the multipole electrodes) 510 and 520 are installed between the first and second focus electrodes 51 and 52 to form a quadrupole lens (or a multipole lens).

Figure 11:
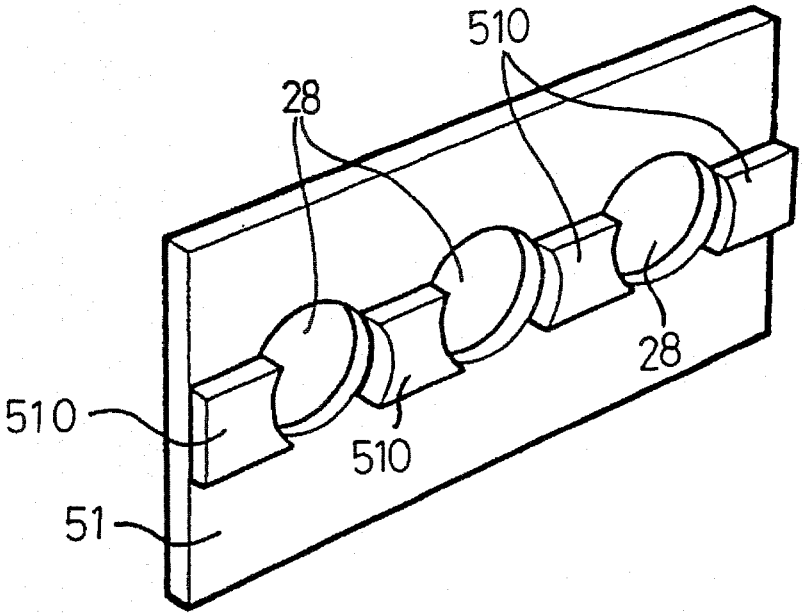
FIG. 11 is a perspective view of a first quadrupole electrode for the electron gun of FIG. 6 according to one embodiment of the present invention.
Figure 12:
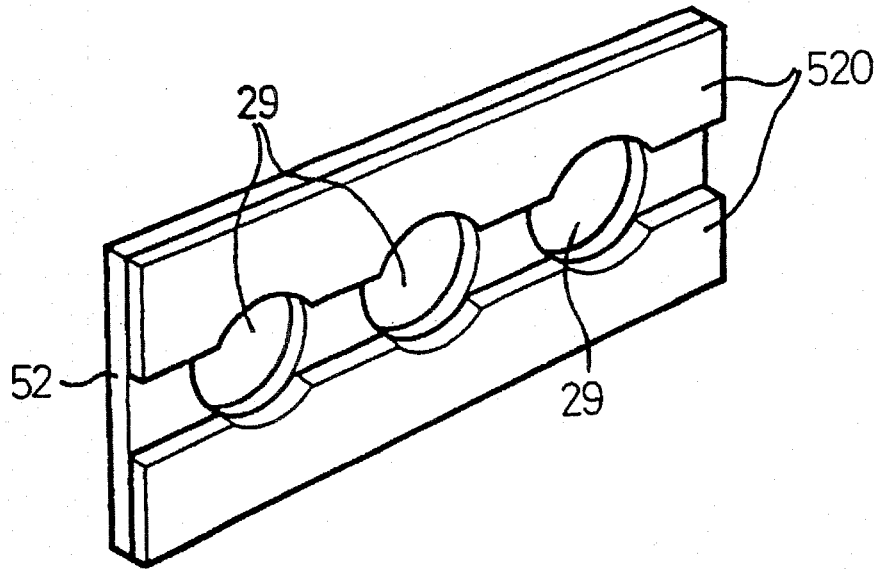
FIG. 12 is a perspective view of a second quadrupole electrode for the electron gun of FIG. 6 according to one embodiment of the present invention.
Figure 13:
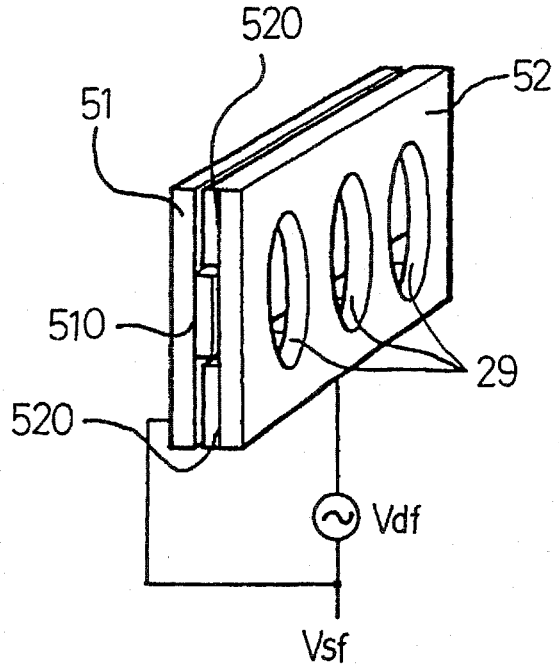
FIG. 13 is a perspective view showing the quadrupole electrode of the electron gun according to one embodiment of the present invention wherein first and second quadrupole electrodes are combined.

FIGS. 11 to 13 show the structure of the quadrupole electrodes 510 and 520 according to one embodiment of the present invention.

Referring to FIG. 11, the first quadrupole electrode is composed of a plurality of first electrode pieces 510 which are connected to one surface of the first focus electrode 51, being parallel to a line connecting the centers of the beam-passing apertures 28 formed on the first focus electrode 51. Each of the first electrode pieces has at least one arc having a radius of Rs, which is in alignment with the circumference of the beam-passing apertures 28. The first quadrupole electrode pieces 510 control the horizontal size of the electron beams when the beams are deflected on the tube screen.

Referring to FIG. 12, the second quadrupole electrode is composed of a plurality of second electrode pieces 520 which are connected to upper and lower portions of one surface of the second focus electrode 52, being opposite to the first quadrupole electrode 51. Each of the second electrode pieces 520 has arcs having a radius of Rd, which are in alignment with the circumference of the beam-passing apertures 29. The second quadrupole electrode pieces 520 control the vertical size of the electron beams when the beams are deflected on the tube screen.

Referring to FIG. 13, the first and second quadrupole electrodes 510 and 520 have a predetermined thickness, and are combined with each other so that the first quadrupole electrode pieces 510 are inserted inside of the second quadrupole electrode pieces 520.

Now, the operation of the electron gun according to the present invention as constructed above will be explained.

The electron beams emitted from the beam-forming region are focused by the main lens, passing through the first quadrupole electrode 510 connected to the first focus electrode 51 and the second quadrupole electrode 520 connected to the second focus electrode 52, and then the focused electrode beams reach the tube screen, resulting in formation of an image on the screen. The quadrupole lens formed by the quadrupole electrodes 510 and 520 is activated especially when the electron beams are deflected to the peripheral portions of the screen. The first quadrupole electrode 510 is provided with the static focus voltage Vsf, while the second quadrupole electrode 520 is provided with the dynamic focus voltage Vdf which varies according to the deflection amount of the electron beam.

Generally, the larger the screen or the deflection angle becomes, the higher the dynamic focus voltage is determined to be applied than the static focus voltage. The dynamic voltage varies with the parabolic waveform according to the deflection current of the deflection yoke, and is determined to be higher than the static focus voltage by about 300 V to 600 V.

Figure 14:
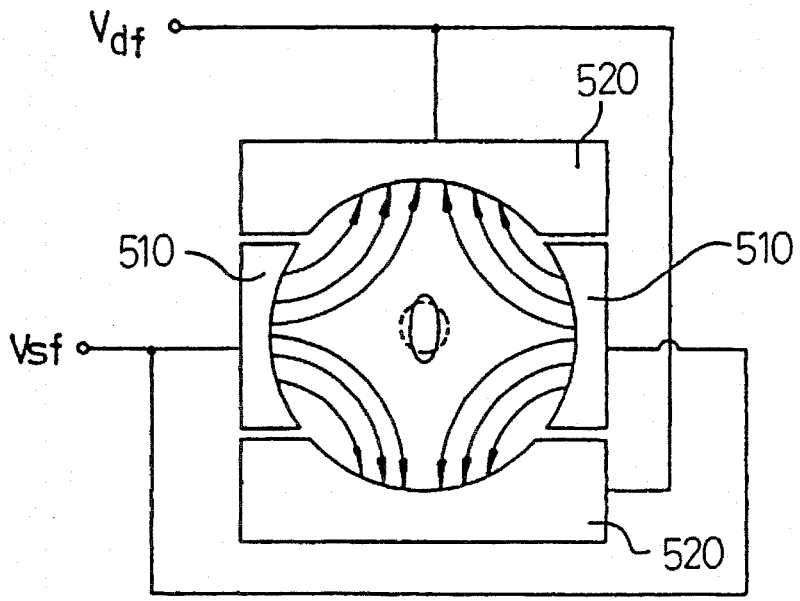
FIG. 14 is a view showing a quadrupole magnetic field formed by the electron gun according to the present invention.

When the dynamic focus voltage is applied, the quadrupole lens is activated due to the difference between the static focus voltage and the dynamic focus voltage and causes the shape of the electron beam to be lengthened in the vertical direction as shown in FIG. 14. As a result, a desirable focus characteristic can be obtained even in the peripheral regions of the screen since the haze occurring due to the nonuniform magnetic field is improved.

Figure 15:
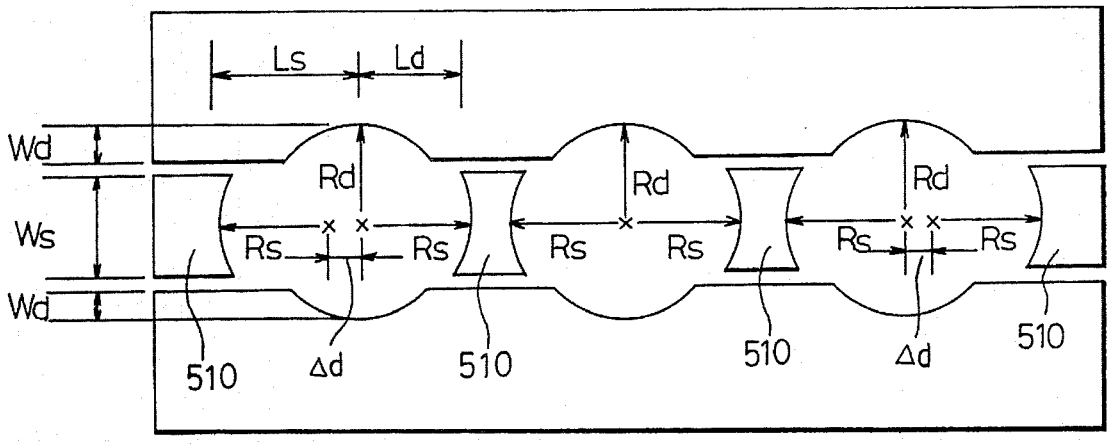
FIG. 15 is a view explaining the dimensions of the quadrupole electrode of FIG. 13 according to the present invention.
Figure 16:
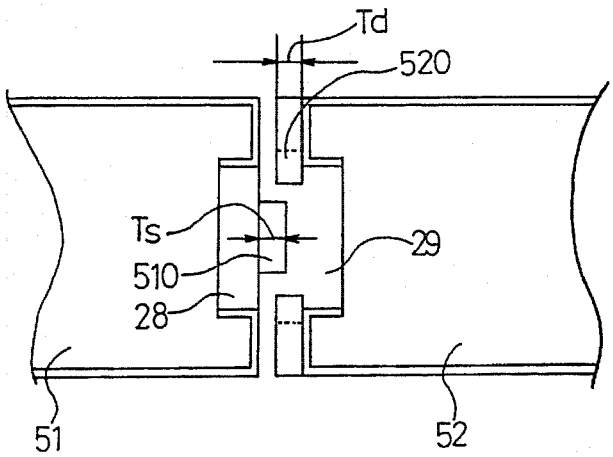
FIG. 16 is a partially sectional view of the quadrupole electrode of FIG. 13 according to the present invention.

Referring to FIGS. 15 and 16, design factors of the quadrupole electrodes according to the present invention are as follows:

Ls indicates a horizontal distance from the center of the beam-passing aperture to the first quadrupole electrode 510 connected to the first focus electrode;

Ld indicates a vertical distance from the center of the beam-passing aperture to the second quadrupole electrode 520 connected to the second focus electrode;

Ws indicates a vertical width of the first quadrupole electrode 510 connected to the first focus electrode;

Wd indicates a dynamic radius insertion width of the second quadrupole electrode 520 connected to the second focus electrode;

Ts indicates a static thickness of the first quadrupole electrode 510; and

Td indicates a dynamic thickness of the second quadrupole electrode 520.

As a result of computer simulation, the following characteristics can be obtained with respect of the above-mentioned design factors:

1) Ls>Ld>Rs: (wherein Rs is the radius of the beam-passing aperture)

The longer Ls becomes, the larger the horizontal size of the electron beam in the peripheral portion of the tube screen becomes. The shorter Ls becomes, the smaller the horizontal size of the electron beam becomes. However, if the horizontal size of the electron beam comes to a prescribed critical range, the haze occurs in the horizontal direction of the electron beam. The condition Ls>Ld must be satisfied to minimize the size of the electron beam (on condition that Ts=Td, and Ws=2Wd).

2) Ts>Td:

Ts is determined to control the electron beam in the horizontal direction. If Ts becomes larger, the haze occurs in the horizontal direction; while if Ts becomes smaller, a blooming phenomenon occurs, causing the size of the electron beam gradually to become larger. Meanwhile, Td is related to the vertical size (i.e., haze) of the electron beam in the peripheral portion of the tube screen. Accordingly, the larger the tube screen becomes, the thicker Td must be, and the condition Ts<Td must be satisfied (on condition that Rs=Ld, and Ws=2Wd).

3) Ts≧2Wd:

The larger Ws becomes, the smaller the horizontal size of the electron beam in the peripheral portion of the tube screen becomes. However, if the horizontal size of the electron beam comes to a prescribed critical range, the haze occurs in the horizontal direction of the electron beam. Meanwhile, if Wd becomes larger, the vertical size (i.e., haze) of the electron beam in the peripheral portion of the tube screen can be reduced, but the haze in the horizontal direction of the electron beam is increased in the peripheral portion of the tube screen, thereby deterioration of the electron beam is increased in the peripheral portion of the tube screen, thereby deteriorating the focusing characteristic in the peripheral portion of the tube screen. Consequently, the condition Ws≧2Wd must be satisfied.

Figure 17:
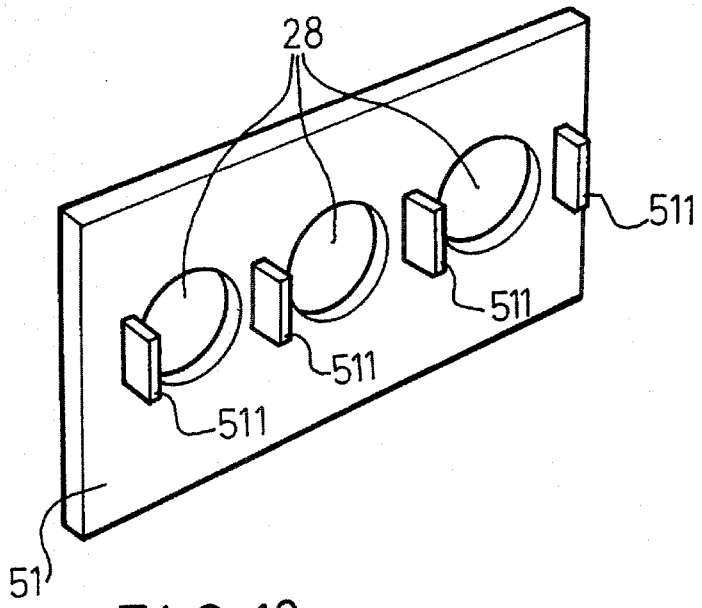
FIG. 17 is a perspective view of a first electrode of a quadrupole electrode for the electron gun according to another embodiment of the present in invention.
Figure 18:
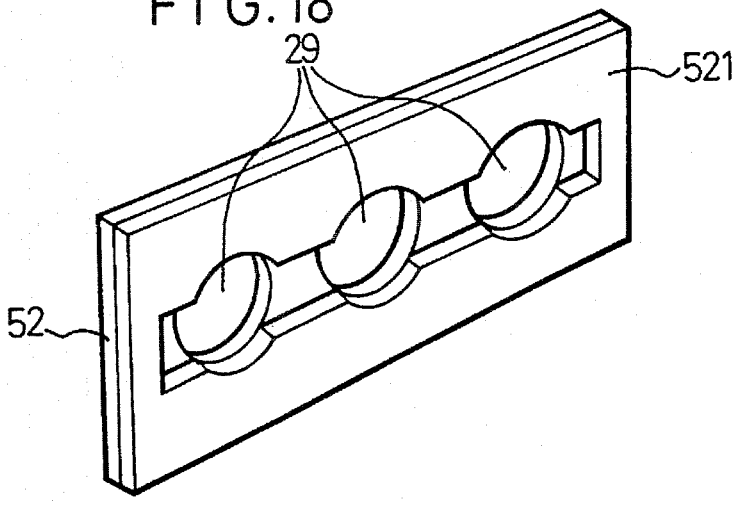
FIG. 18 is a perspective view of a second electrode of a quadrupole electrode for the electron gun according to another embodiment of the present invention.
Figure 19:
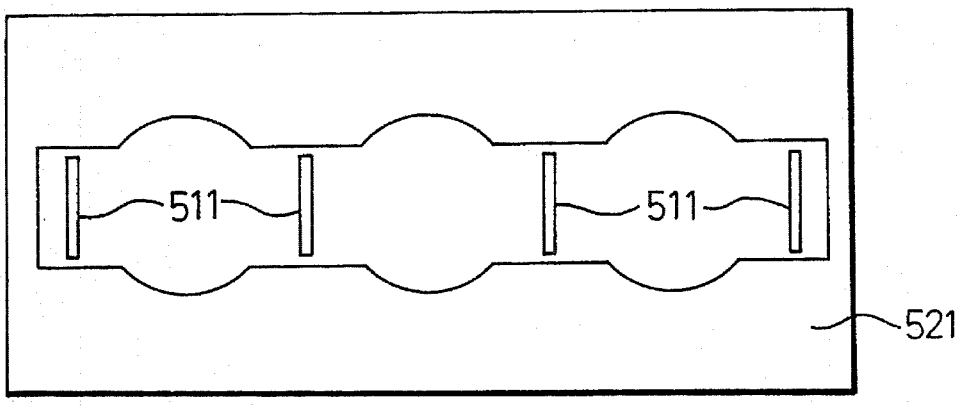
FIG. 19 is a cross-sectional view showing the quadrupole electrode according to another embodiment of the present invention wherein first and second electrodes are assembled.
Figure 20A:
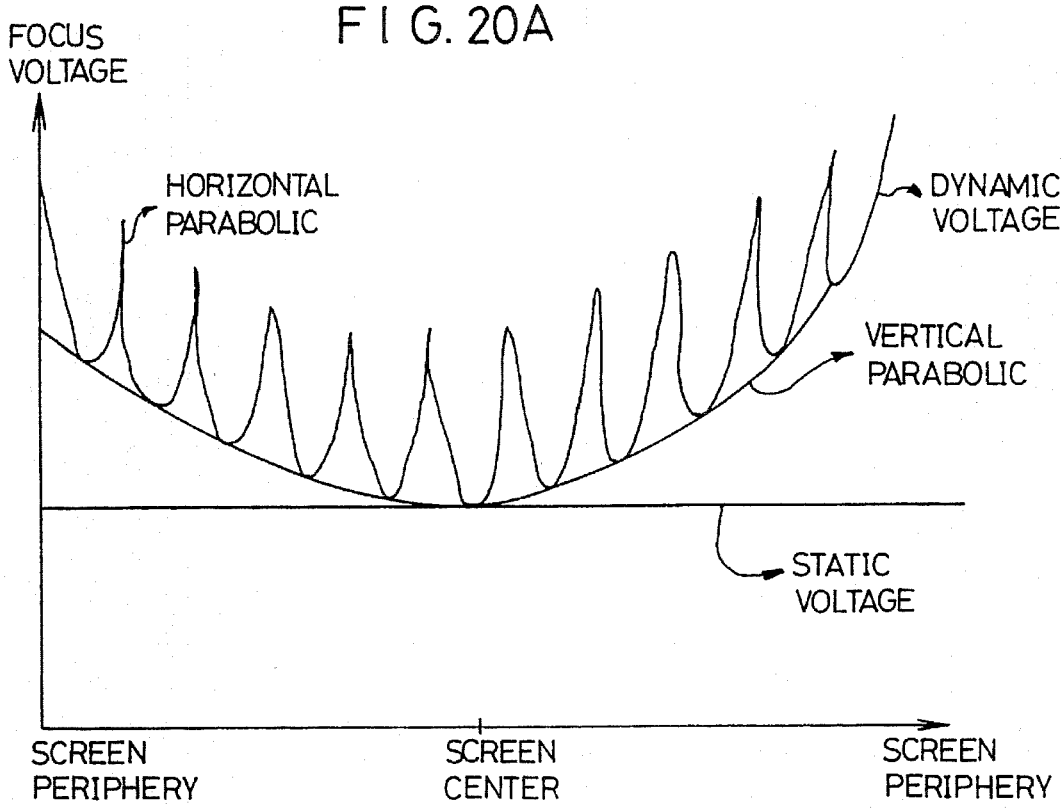
FIGS. 20A and 20B are graphs showing the relationship between the focusing voltage and the position of the display screen.
Figure 20B:
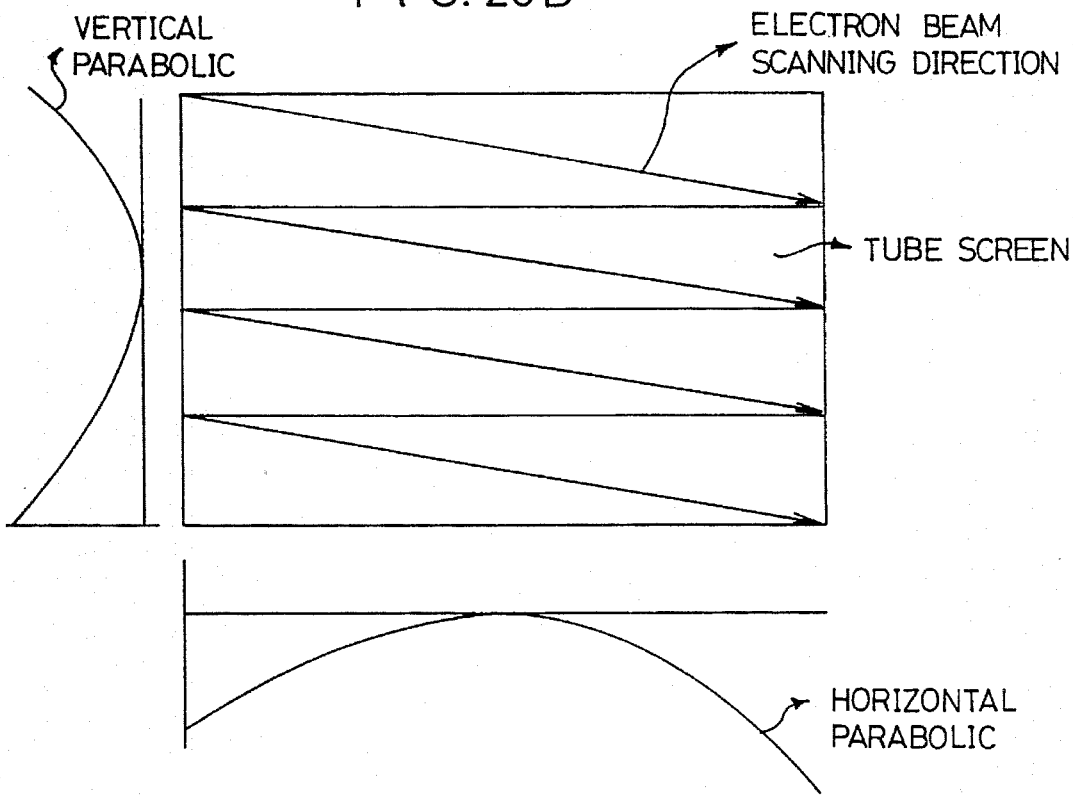

FIGS. 17 to 19 show the structure of the quadrupole electrodes according to another embodiment of the present invention. In this embodiment, the first quadrupole electrode 511 connected to the first focus electrode 51 is composed of a plurality of vertical partitions connected to one surface of the first focus electrode 51, being located on left and right sides of the beam-passing apertures 28 formed on the first focus electrode 51, and the second quadrupole electrode 521 comprises a flat plate having a horizontally-elongated opening therein in alignment with the beam-passing apertures 29. Specifically, the upper and lower portions of the opening have arcs the number of which is the same as that of the beam-passing apertures 29, respectively, and each of which has a radius identical to or larger than that of the beam-passing apertures 29. The vertical partitions constituting the first quadrupole electrode 511 are inserted inside of the horizontally-elongated opening formed on the second quadrupole electrode 521 to form the quadrupole lens.

The operation and the feature of the quadrupole electrodes according to this embodiment are same as those of the quadrupole electrodes according to one embodiment as described above, and thus the description thereof will be omitted.

As described above, the electron gun for a color cathode-ray tube according to the invention can attain an improved focusing characteristic over the whole screen by scanning a vertically-lengthened electron beam in the peripheral portion of the screen which is mostly affected by the deflection magnetic field, and by scanning a circular electron beam in the center portion of the screen, thereby enhancing the resolution of the tube.

While the present invention has been described with reference to the preferred embodiments thereof, it will be understood by those skilled in the art that various changes in form and details may be made therein without departing from the spirit and scope of the invention as defined by the appended claims.

What is claimed is:

1. An electron gun for a color cathode-ray tube, comprising:

a plurality of electron emission means for emitting electron beams;

a beam-forming region composed of a control electrode for controlling a quantity of said electron beams emitted from said plurality of electron emission means, and an accelerator electrode for accelerating said controlled electron beams;

a plurality of focus electrodes for forming a main static focus lens for focusing said electron beams on a screen of said cathode-ray tube, one of said plurality of focus electrodes forming a static voltage focus electrode by applying thereto a static voltage, and one of the remaining focus electrodes forming a dynamic voltage focus electrode by applying thereto a dynamic voltage;

an anode for accelerating said focused electron beams onto said screen; and quadrupole electrode means, provided between said static voltage focus electrode and said dynamic voltage focus electrode, for forming a quadrupole lens, said quadrupole electrode means comprising a first quadrupole electrode composed of a plurality of vertical partitions connected to one surface of said static voltage focus electrode and arranged on left and right sides of beam-passing apertures formed on said static voltage focus electrode, and a second quadrupole electrode composed of a flat plate connected to said dynamic voltage focus electrode and having a horizontally-elongated opening therein in alignment with said beam-passing apertures; upper and lower portions of said opening having arcs having a radius at least as large as that of said beam-passing apertures;

wherein said static voltage focus electrode and said dynamic voltage focus electrode are arranged at predetermined intervals, and said vertical partitions connected to said static voltage focus electrode are inserted inside of said horizontally-elongated opening formed on said second quadrupole electrode.

2. An electron gun as claimed in claim 1, wherein a height of said vertical portions connected to said static voltage focus electrode is determined to be longer than a width of said second quadrupole electrode connected to said dynamic voltage focus electrode, wherein the height and the width are defined with respect to an axial direction of said electron gun.

3. An electron gun as claimed in claim 1, wherein the radius of the arcs is identical to that of said beam-passing apertures.

4. An electron gun as claimed in claim 1, wherein the radius of the arcs is larger than that of said beam-passing apertures.

* * * * *